US006009667A

United States Patent [19]

Mizukami

[11] Patent Number: 6,009,667

[45] Date of Patent: Jan. 4, 2000

[54] HINGE MECHANISM FOR SUPPORTING THE OPEN-CLOSE COVER OF A VACUUM-PROCESS APPARATUS

[75] Inventor: Masami Mizukami, Kofu, Japan

[73] Assignee: Tokyo Electron Limited, Tokyo, Japan

[21] Appl. No.: 09/161,986

[22] Filed: Sep. 29, 1998

[30] Foreign Application Priority Data

Sep. 30, 1997 [JP] Japan ..... 9-265290

[51] Int. Cl.[7] ..... E05D 15/48

[52] U.S. Cl. ..... 49/153; 16/354

[58] Field of Search ..... 49/246, 247, 153, 49/254, 149, 152; 16/354

[56] References Cited

U.S. PATENT DOCUMENTS 1,120,163 12/1914 Sanders ..... 16/354
5,195,210 3/1993 Lee ..... 16/354 X

FOREIGN PATENT DOCUMENTS 505691 8/1930 Germany ..... 49/246

*Primary Examiner*—Jerry Redman

*Attorney, Agent, or Firm*—Oblon, Spivak, McClelland, Maier & Neustadt, P.C.

[57] ABSTRACT

A hinge mechanism for use with a cover for opening and closing a hole. The mechanism is designed to support the cover and enable the cover to rotate through an angle greater than 90° between an opened position and a closed position. The mechanism comprises an axle to be secured to the chamber, a support member having a first part rotatably supported by the axle and a second part spaced from the first part, a rotary member to be secured to the cover, the rotary member rotatably supported by the second part of the support member and capable of rotating around the support member when the cover is rotated, and a rotation-transmitting mechanism supported by the support member, connecting the rotary member to the axle to allow the support member to rotate in a first direction around the axle when the rotary member is rotated in a second direction opposite to the first direction. Once the hinge mechanism is incorporated in the vacuum-process apparatus, with the axle and the rotary member secured to the chamber and the cover, respectively, the support member can rotate in the direction opposite to the direction the cover is rotated around the rotary member between the closed position and the open position.

20 Claims, 3 Drawing Sheets

HINGE MECHANISM FOR SUPPORTING THE OPEN-CLOSE COVER OF A VACUUM-PROCESS APPARATUS

BACKGROUND OF THE INVENTION

The present invention relates to a hinge mechanism designed to support the open-close cover of a vacuum-process apparatus for processing objects (e.g., liquid-crystal display (LCD) substrates and semiconductor wafers) and to enable the cover to rotate between an opened position and a closed position.

Generally, a vacuum-process apparatus for processing objects such as LCD substrates and semiconductor wafers comprises a load lock chamber and a process chamber. The load lock chamber has a transfer arm. The process chamber is located near the load lock chamber. A vacuum is maintained in both chambers. The transfer arm transfers objects, one by one, from the load lock chamber into the process chamber. In the process chamber, the objects are subjected to a specific process. The transfer arm transfers the objects, thus processed, from the process chamber back into the load lock chamber.

The process chamber comprises a main body (hereinafter referred to as "chamber body"). The chamber body has an inlet/outlet port made in one side. Through the inlet-outlet port, the objects are moved into and out of the process chamber. The process camber further comprises a gate valve and an air cylinder. The gate valve is located at the inlet/output port. The air cylinder is provided at said side of the chamber body, positioned above the gate valve and connected to the gate valve. The gate valve opens the inlet/outlet port when it is driven upwardly by the air cylinder, and closes the port when it is driven downwardly by the air cylinder.

The chamber body has a maintenance hole in the top. The maintenance hole can be opened and closed by a cover (hereinafter referred to as "open-close cover"). The open-close cover can rotate between an opened position and a closed position, supported by a hinge mechanism which is secured to the chamber body. The open-close cover usually closes the maintenance hole, thus maintaining vacuum in the process chamber. The interior of the process chamber needs to be cleaned periodically (for example, once or twice every month), and the heater provided in the process chamber must be replaced with a new one after a long use. The interior of the chamber cannot be cleaned or the heater cannot be replaced with a new one, without opening the maintenance hole. To open the maintenance hole, the hinge mechanism is operated, rotating the open-close cover upwardly to the opened position.

The hinge mechanism has one axle. The axle supports the open-close cover, which weighs as much as about 5 Kg. Being so heavy, the open-close cover may rotate downwardly, by accident, from the opened position to the closed position. In view of this, it is desired that the open-close cover be rotated by more than 90°, preferably about 100°, from the closed position to the opened position, thereby to open the maintenance hole. If the open-close cover is rotated through an angle greater than 90°, however, it will hang over the side of the chamber body, coming into interference with the air cylinder, which extends upward to a level above the top of the chamber body. This is because the gap between the chamber body and the hollow cylindrical cover protecting the chamber body is narrow, and the hinge mechanism is inevitably located near the air cylinder. Hence, the open-close cover cannot be rotated upwardly by more than 90°.

BRIEF SUMMARY OF THE INVENTION

The object of the present invention is to provide a hinge mechanism which enables the open-close cover of a vacuum-process apparatus to rotate through an angle greater than 90°, without hanging over the side of the chamber body of the apparatus.

To attain the object of the invention, there is provided a hinge mechanism for use in a vacuum-process apparatus which comprises a chamber having a top wall and a hole made in the top wall and allowing an access to the chamber and which further comprises a cover for opening and closing the hole. The hinge mechanism is designed to support the cover and enable the cover to rotate through an angle greater than 90° between an opened position where the cover opens the hole and a closed position where the cover closes the hole. The hinge mechanism comprises: an axle to be secured to the chamber; a support member having a first part rotatably supported by the axle and a second part spaced apart from the first part; a rotary member to be secured to the cover, the rotary member rotatably supported by the second part of the support member and capable of rotating around the support member when the cover is rotated; and a rotation-transmitting mechanism supported by the support member, connecting the rotary member to the axle to allow the support member to rotate in a first direction around the axle when the rotary member is rotated in a second direction opposite to the first direction. Once the hinge mechanism is incorporated in the vacuum-process apparatus, with the axle and the rotary member secured to the chamber and the cover, respectively, the support member can rotate in the direction opposite to the direction in which the cover is rotated around the rotary member between the closed position and the open position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the invention will be described, with reference to the accompanying drawings.

Figure 1:
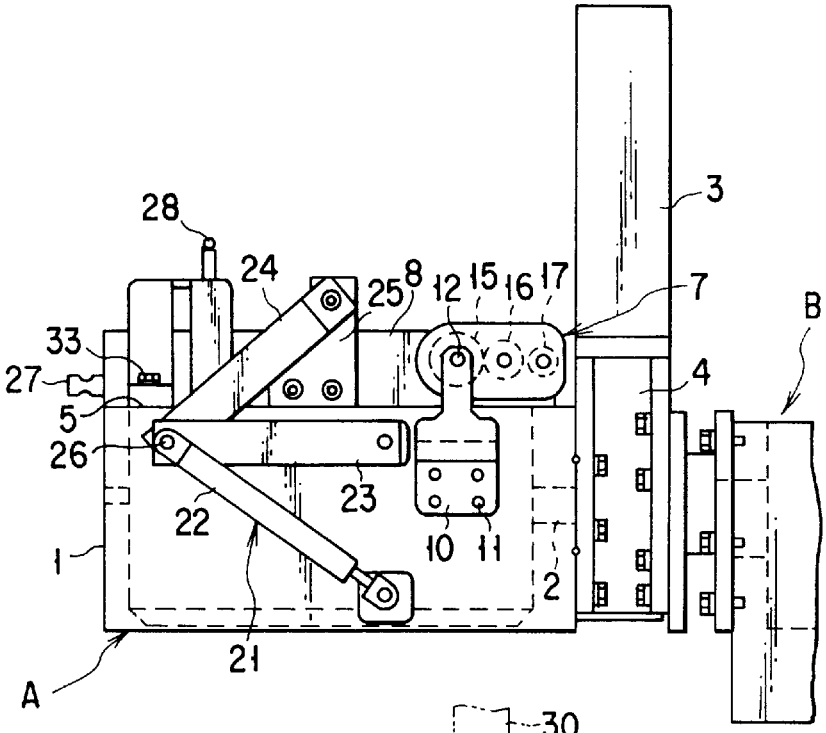
FIG. 1 is a side view of a vacuum-process apparatus, showing an open-close cover rotated downwardly, closing the maintenance hole of the chamber body of the apparatus, while being supported by a hinge mechanism according to a first embodiment of the invention.
Figure 2:
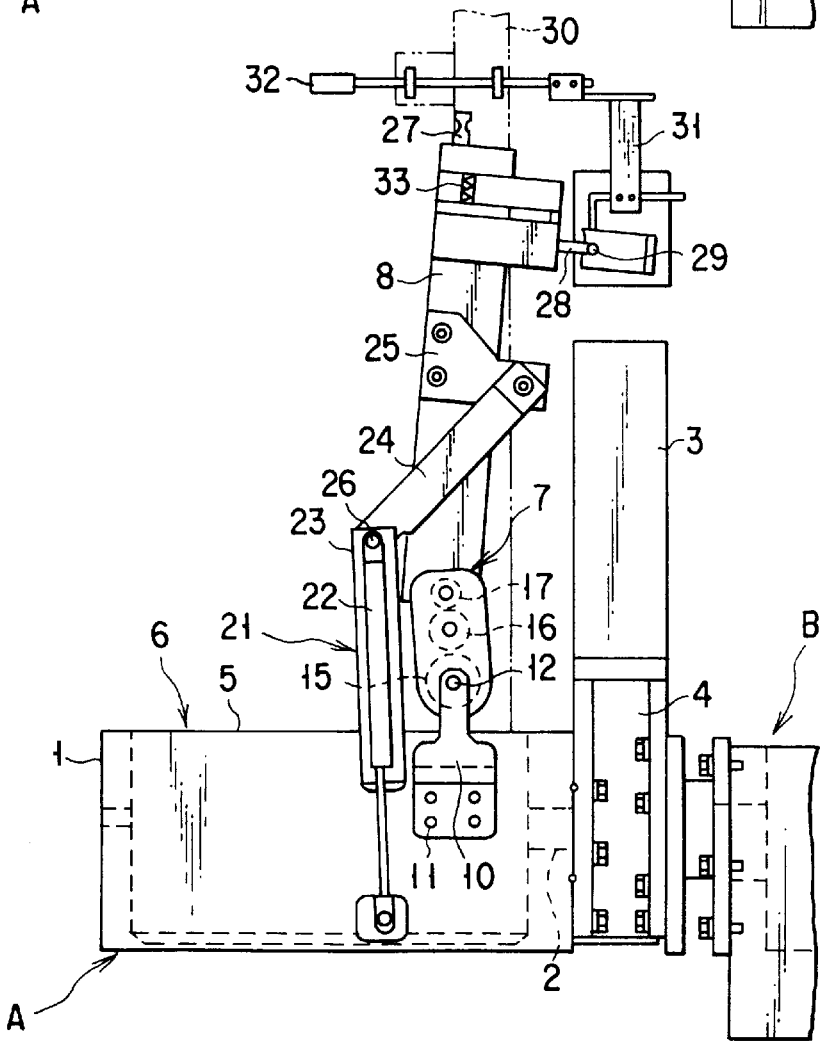
FIG. 2 is a side view of the vacuum-process apparatus, showing the open-close cover rotated upwardly by more than 90°, opening the maintenance hole, while being supported by the hinge mechanism.

FIGS. 1 and 2 show the process chamber of a vacuum-process apparatus which has hinge mechanisms 7 according to the first embodiment of the invention. As shown in FIGS. 1 and 2, the vacuum-process apparatus comprises a load lock chamber B and a process chamber A. The load lock chamber B has a transfer arm (not shown). The process chamber A is located near the load lock chamber B. A vacuum is maintained in both chambers A and B. The transfer arm transfers objects, such as semiconductor wafers, one by one, from the load lock chamber B into the process chamber A. In the process chamber A, the objects are subjected to a specific process. The transfer arm transfers the objects, thus processed, from the process chamber A back into the load lock chamber B.

The process chamber A comprises a chamber body 1. The chamber body 1 has an inlet-outlet port 2 made in one side. The inlet/output port 2 is extends horizontally. Through the port 2, the objects are moved into and out of the process chamber A. The process camber A further comprises an air cylinder 3 and a gate valve 4. The gate valve 4 is located at the inlet/output port 2. The air cylinder 3 is provided on said side of the chamber body 1 and is positioned above the gate valve 4. The air cylinder 3 extends vertically along the side of the chamber body 1, with its top located above the top 5 of the chamber body 1. The air cylinder 3 has a rod, which is connected to the gate valve 4. The gate valve 4 opens the inlet-outlet port 2 when it is pulled upwardly by the rod of the air cylinder 3, and closes the port 2 when it is pushed down by the rod of the air cylinder 3.

The chamber body 1 has a maintenance hole 6 in the top 5. The maintenance hole 6 is a circular one. The hole 6 can be opened and closed by an open-close cover 8. The open-close cover 8 can rotate round the shaft 18 between an opened position and a closed position, supported by a pair of hinge mechanisms 7, which are secured to the opposite two sides of the chamber body 1. In process operation, the open-close cover 8 remains rotated to the closed position (FIG. 1), closing the maintenance hole 6 and, thus, maintaining a vacuum in the process chamber A. When necessary, the open-close cover 8 is rotated through an angle greater than 90°, from the closed position to the opened position (FIG. 2), while supported by the hinge mechanisms 7. In this case, the open-close cover 8 opens the maintenance hole 6, whereby the interior of the chamber A can be cleaned or the heater provided in the chamber A can be replaced with a new one. Either hinge mechanism 7 is located near the gate valve 4, supporting one end of the open-close cover 8 such that the open-close cover 8 may be rotated upward and downward.

As shown in FIGS. 1, 2 and 3, each hinge mechanism 7 has a first connecting member 10, a casing (support member) 14, and a second connecting member (rotary member) 19. The proximal end of the first connecting member 10 (i.e., lower end in FIGS. 1 and 2) is secured by screws 11 to that part of the side wall of the chamber body 1 which is close to the gate valve 4. The distal end portion of the first connecting member 10 (i.e., upper end in FIGS. 1 and 2) extends upward, with its top located a little above the top 5 of the chamber body 1.

The pair of hinge mechanisms 7 are identical to each other in structure, but, each one is the mirror image structure of the other. One of the mechanisms 7 will be described in detail, with reference to FIGS. 4 and 5.

Figure 4:
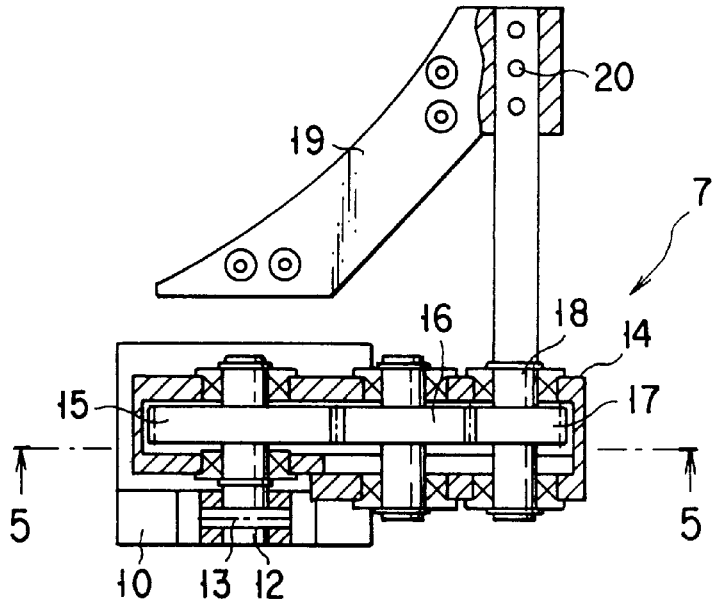
FIG. 4 is a cross-sectional view of the hinge mechanism shown in FIG. 1.
Figure 5:
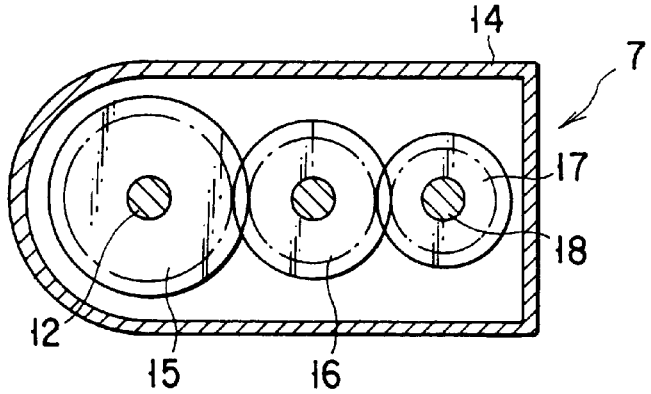
FIG. 5 is a sectional view of the hinge mechanism, taken along line 5—5 in FIG. 4.

As shown in FIG. 4, a shaft 12 transversely extends in the distal end portion of the first connecting member 10. The shaft 12 is held by a pin 13 and cannot rotate in the first connecting member 10. The casing 14 is rotatably mounted on the shaft 12. The casing 14 contains a first gear 15, an intermediate gear 16, and a second gear 17. The first gear 15 is mounted on the shaft 12 and cannot be rotated at all. The intermediate gear 16 is rotatable and in mesh with the first gear 15 and the second gear 17. The second gear 17 is fixed to a shaft (rotary member) 18. The shaft 18 transversely extends partly in the casing 14 and partly outside the casing 14. Unlike the shaft 12, the shaft 18 is rotatable.

The second connecting member 19 secured at one end, by screws 20, to that part of the shaft 18 which extends outside the casing 14. The other end of the second connecting member 19 is fastened to the open-close cover 8. It should be noted that the first gear 15 has thirty-two teeth, the intermediate gear 16 twenty-four teeth, and the second gear 17 sixteen teeth. The ratio of the number of teeth on the first gear 15 to the number of teen on the second gear 17 is 2:1.

When the open-close cover 8 is rotated upwardly, opening the maintenance hole 6, the shaft 18 is rotated clockwise (FIG. 5), because the second connecting member 19 is fastened at one end to the open-close cover 8 and at the other to the shaft 18. The second gear 17 fixed on the shaft 18 therefore rotates clockwise. The intermediate gear 16 rotates counterclockwise around its axis and rolls counterclockwise on the circumference of the first gear 15. This is because the intermediate gear 16 is in mesh with the second gear 17 and the first gear 15. As a result, the casing 14 which holds the second gear 17 is rotated counterclockwise around the shaft 12. Thus, the first gear 15, second gear 16 and intermediate gear 16 constitute a rotation-transmitting mechanism that couples the shafts 12 and 18 together, thereby to rotate the casing 14 counterclockwise around the shaft 12 when the shaft 18 is rotated clockwise.

As mentioned above, the other hinge mechanism is a mirror image structure of the hinge mechanism 7 described above. Therefore, the casing 14, gears 15 to 17 and shaft 18 of the other hinge mechanism rotate in the directions opposite to the directions in which their counterparts of the hinge mechanism 7, when the open-close cover 8 is rotated.

As shown in FIGS. 1 and 2, an auxiliary mechanism 21 is provided beside one of the hinge mechanism 7, for make it possible to rotate the open-close cover 8 smoothly. The auxiliary mechanism 21 comprises a gas spring (i.e., bias means) 22 and two links 23 and 24. The gas spring 22 has one end rotatably connected to the side of the chamber body 1. The first link 23 has one end rotatably connected to the side of the chamber body 1 and located above the gas spring 22. The second link 24 has one end rotatably connected the side of the open-close cover 8 by a bracket 25. The other ends (i.e., free ends) of the gas spring 22, first link 23 and second link 24 are rotatably coupled to one another by a pin 26.

When the open-close cover 8 is rotated upwardly to open the maintenance hole 6, the gas spring 22 expands by virtue of the gas pressure generated in it, thus facilitating the upward moving of the open-close cover 8. As long as the open-close cover 8 stays in the perfectly horizontal position and closing the hole 6 as shown in FIG. 1, the gas pressure in the gas spring 22 does not work to rotate the open-close cover 8 due to the weight of the open-close cover 8. Namely, the gas spring 22 is inhibited from expanding. When the open-close cover 8 is rotated a little upwardly from its closed position, the gas pressure starts working to rotate the open-close cover, or expanding the gas spring 22. In other words, the gas pressure in the spring 22 is converted to a force which is transmitted via the links 23 and 24, rotating the open-close cover 8 upward around the shafts 12 of both hinge mechanisms 7. The auxiliary mechanism 21 enables an operator to open the open-close cover 8, only if he or she pull the open-close cover 8 with a small force.

A handle 27 is attached to that end of the open-close cover 8 which opposes the end which the hinge mechanisms 7 support the open-close cover 8. The operator may hold the handle 27 to pull the open-close cover 8 upwardly. A striker 28 is secured to the top of the open-close cover 8. When the open-close cover 8 is rotated upward through an angle greater than 90° from the closed position to the opened position as shown in FIG. 2, the striker 28 comes to oppose a latch mechanism 29 provided on a base 30, and the latch mechanism 29 holds the striker 28. The open-close cover 8 is thereby locked and held in the opened position (FIG. 2). The latch mechanism 29 has an unlocking member 31, which is coupled to a lever 32. When the lever 32 is operated, the unlocking member 31 releases the striker 28 from the latch mechanism 29.

A plurality of bolts 33 are provided in the edges of the open-close cover 8, for fastening the open-close cover 8 to the chamber body 1. When the bolts 33 are rotated into the screw holes made in the top 5 of the chamber body 1, the open-close cover 8 closes the maintenance hole 6 firmly and completely.

How the open-close cover 8 is rotated will be described.

Figure 3A:
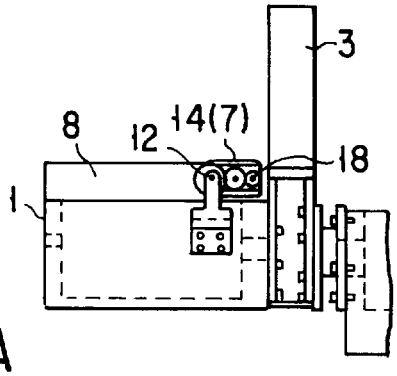
FIGS. 3A to 3H are side views of the vacuum-process apparatus, for explaining how the hinge mechanism operates to support the open-close cover as the open-close cover is rotated upwardly from a closed position to an open position.

In order to perform periodical cleaning in the process chamber A or replace the heater with a new one, the open-close cover 8 must be rotated upwardly from the closed position (FIG. 3A). To this end, the bolts 33 in the peripheral edges of the open-close cover 8 are rotated and released from the screw holes made in the top 5 of the chamber body 1. The open-close cover 8 is therefore no longer fastened to the chamber body 1. Then, the operator holds the handle 27 and rotates the open-close cover 8 upwardly (clockwise).

In each hinge mechanism 7, the shaft 18 transmits the rotation of the open-close cover 8 to the second gear 17, which rotates clockwise. The intermediate gear 16 rotates counterclockwise because it is set in mesh with the second gear 17. At the same time, the intermediate gear 16 rolls on the circumference of the first gear 15 in the counterclockwise direction. The second gear 17 moves counterclockwise around the first gear 15, while rotating clockwise around its axis, since it is set in mesh with both the first gear 15 and the intermediate gear 16. As a result, the casing 14 rotates counterclockwise around the shaft 12, as shown in FIGS. 3A to 3H. When the casing 14 rotates counterclockwise as the open-close cover 8 is rotated clockwise around the shaft 18, it moves the open-close cover 8 away from the air cylinder 3.

With reference to FIGS. 3A to 3H it will be described how each of the hinge mechanisms 7 operates to facilitate the rotation of the open-close cover 8.

As the open-close cover 8 is gradually rotated from the closed position by an angle less than 90° around the shaft 18, the angle between the line a connecting the axes of the shafts 12 and 18 and the line b extending from the axis of the shaft 18 in the lengthwise direction of the open-close cover 8 gradually increases as can be understood from FIGS. 3A to 3F. As the open-close cover 8 is so rotated, an isosceles triangle remains formed, whose equal sides are lines a and b (see FIG. 3D).

Figure 3B:
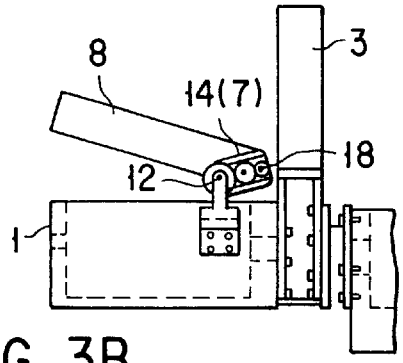
Figure 3C:
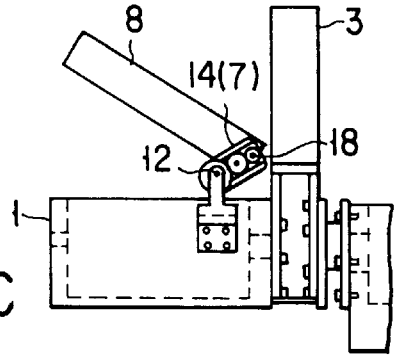
Figure 3D:
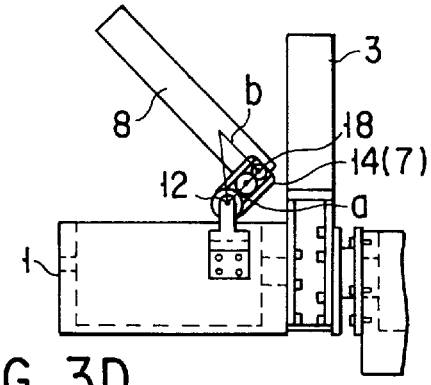
Figure 3E:
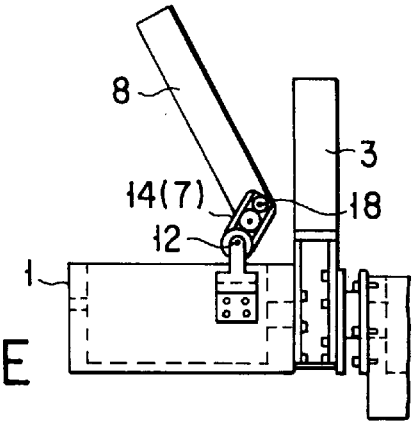
Figure 3F:
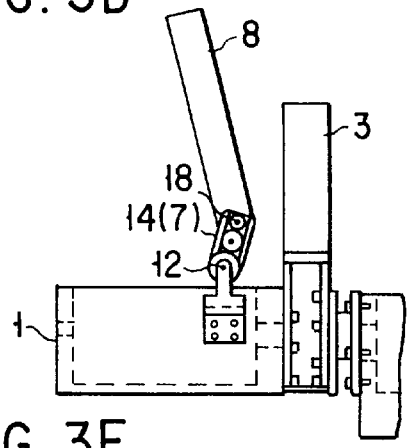

As long as the open-close cover 8 remains in the closed position as shown in FIG. 3A, the auxiliary mechanism 21 does not perform its function. More precisely, the gas spring 22 cannot expand to rotate the open-close cover 8 clockwise due to the weight of the open-close cover 8, in spite of the gas pressure generated in the gas spring 22. When the open-close cover 8 is rotated clockwise a little as shown in FIG. 3B, the links 23 and 24 starts rising. In other words, the gas spring 22 beings to expand. This means that the gas pressure in the spring 22 now acts to rotate the open-close cover 8. In short, the auxiliary mechanism 21 facilitates the rotation of the open-close cover 8. Thus, the operator can open the open-close cover 8 with a relatively small force.

Figure 3G:
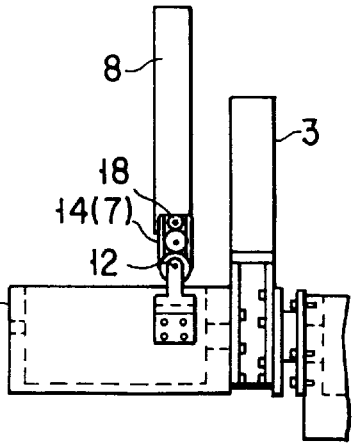
Figure 3H:
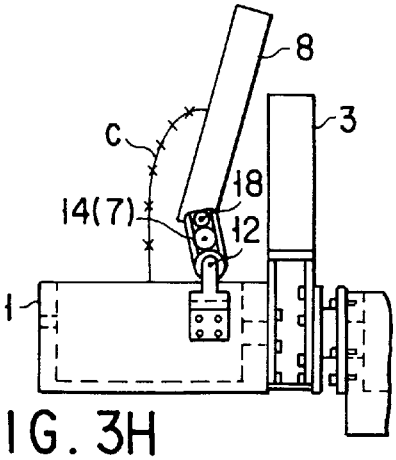

Eventually, the open-close cover 8 is rotated through 90°, standing upright as shown in FIG. 3G. In this state, the axes of the gears 15, 16 and 17 in the casing 14 of either hinge mechanism 7 are in a vertical line. When the open-close cover 8 is rotated clockwise by an angle greater than 90° as shown in FIG. 3H, the striker 28 comes into engagement with the latch mechanism 29. The open-close cover 8 is therefore locked in the opened position, after it has been rotated by an angle greater than 90°. Once locked so, the open-close cover 8 would not be rotated counterclockwise by accident. Maintenance work on the process chamber A, such as cleaning of the interior of the chamber body 1 or replacing of the heater, can therefore be accomplished in safety.

While remaining rotated by an angle greater than 90° as is illustrated in FIG. 3H, the open-close cover 8 would not interfere with the air cylinder 3. This is because the casings 14 move the open-close cover 8 away from the air cylinder 3 when they rotate counterclockwise as the open-close cover 8 is rotated clockwise around the shaft 18. That is, as the open-close cover 8 is rotated clockwise around the shaft 18, both hinge mechanisms 7 rotate counterclockwise around the shaft 12, thus moving the open-close cover 8 away from the air cylinder 3. As the open-close cover 8 supported by the hinge mechanisms 7 is rotated clockwise, its center moves in an elliptic locus c illustrated in FIG. 3H.

After the completion of the maintenance work, the open-close cover 8 is rotated counterclockwise in the following manner, in order to close the maintenance hole 6. First, the lever 32 is operated, pushing the unlocking member 31. The member 31, thus pushed, releases the striker 28 from the latch mechanism 29. Then, the open-close cover 8 is rotated downwardly, or counterclockwise, while being braked by the gas spring 22. Both hinge mechanisms 7 gradually rotate clockwise around the shaft 12 as shown in FIGS. 3G to 3B. Eventually, the open-close cover 8 abuts on the top 5 of the chamber body 1 as shown in FIG. 3A, closing the maintenance hole 6. The bolts are rotated into the screw holes made in the top 5 of the chamber body 1, whereby the open-close cover 8 is secured to the chamber body 1, closing the maintenance hole 6 completely.

As described above, the hinge mechanisms 7 enable the open-close cover 8 to rotate through an angle greater than 90° from the closed position, without hanging over the side of the chamber body 1. Hence, the open-close cover 8 would not interfere with the air cylinder 3 which extends upward to a level above the top of the chamber body 1 and which is designed to open and close the gate valve 4. Furthermore, once rotated from the closed position through an angle greater than 90°, the open-close over 8 would not rotate downwardly by accident.

Figure 6:
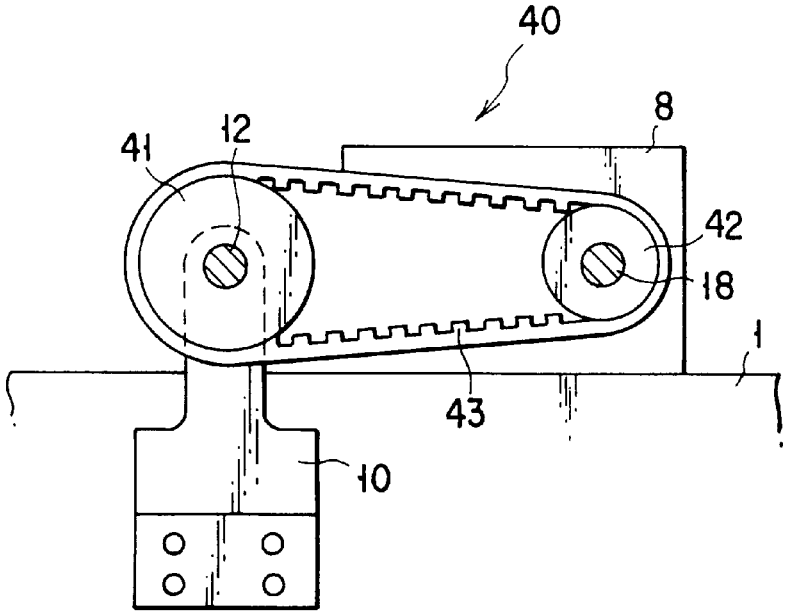
FIG. 6 is a schematic side view of a hinge mechanism according to a second embodiment of the present invention.

FIG. 6 shows a hinge mechanism 40 according to a second embodiment of the present invention. The hinge mechanism 40 has a first toothed pulley 41, a second toothed pulley 42, and a timing belt 43, instead of such gears as are provided in the first embodiment. Like the first embodiment, the second embodiment comprises a first connecting member 10 and shafts 12 and 18. The first pulley 41 is mounted on the shaft 12 secured to the first connecting member 10 and cannot rotate at all. The second pulley 42 is mounted on the shaft 18 and cannot rotate at all, either. The shaft 18 is secured to the open-close cover of a process chamber of the same type as the process chamber A shown in FIGS. 1 and 2. The timing belt 43, or an endless belt, is wrapped around the pulleys 41 and 42.

The ratio of the circumference of the first pulley 41 to that of the second pulley 42 is 2:1. As the open-close cover is rotated clockwise from the closed position to the open position, the second pulley 42 is moved around the first pulley 41. At the same time, the timing belt 43 runs continuously. Hence, the angle between the line connecting the axes of the shafts 12 and 18 and the line extending from the axis of the shaft 18 in the lengthwise direction of the open-close cover gradually increases as in the first embodiment. As the open-close cover is so rotated, an isosceles triangle remains formed whose equal sides are these lines. Supported by the hinge mechanism 40, the open-close cover of the process chamber is rotated, with its center moving in a vertically elongated elliptic locus similar to the locus c shown in FIG. 3H.

The pulleys 41 and 42 may be replaced by sprocket wheels, and the timing belt 43 may be replaced by an endless chain. If so, the same advantage will be attained.

As has been described above, the present invention can provide a hinge mechanism which enables the open-close cover of a vacuum-process apparatus to rotate easily and smoothly, without hanging over the side of the chamber body of the apparatus and, hence, without interfering with anything provided on the side of the chamber body, such as an air cylinder for opening and closing a gate valve, and which prevents the open-close cover from rotating by accident from the opened position to the closed position so that the maintenance work on the vacuum-process apparatus can be performed in safety.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A hinge mechanism for use in a vacuum-process apparatus which comprises a chamber having a top wall and a hole made in the top wall and allowing an access to the chamber and which further comprises a cover for opening and closing the hole, said hinge mechanism designed to support the cover and enable the cover to rotate through an angle greater than 90° between an opened position where the cover opens the hole and a closed position where the cover closes the hole and said hinge mechanism comprising:

an axle to be secured to the chamber;

a support member having a first part rotatably supported by the axle and a second part spaced apart from the first part;

a rotary member to be secured to the cover, said rotary member rotatably supported by the second part of the support member and capable of rotating around the support member when the cover is rotated; and a rotation-transmitting mechanism supported by the support member, connecting the rotary member to the axle to allow the support member to rotate in a first direction around the axle when the rotary member is rotated in a second direction opposite to the first direction, wherein the support member rotates in the direction opposite to the direction in which the cover is rotated around the rotary member between the closed position and the open position, when the hinge mechanism is incorporated in the vacuum-process apparatus, with the axle and the rotary member secured to the chamber and the cover, respectively.

2. A hinge mechanism according to claim 1, wherein the rotation-transmitting mechanism comprises a first gear secured to the axle and axially aligned therewith, an intermediate gear rotatably mounted on the support member and set in mesh with the first gear, and a second gear secured to the rotary member and set in mesh with the intermediate gear.

3. A hinge mechanism according to claim 1, wherein the rotation-transmitting mechanism comprises a first pulley secured to the axle and axially aligned therewith, a second pulley secured to the rotary member, and an endless belt wrapped around the first and second pulley.

4. A hinge mechanism according to claim 1, wherein the rotary member has a shaft to be secured to the cover.

5. A hinge mechanism according to claim 1, wherein the support member comprises a casing, and the rotation-transmitting mechanism is provided in the casing.

6. A hinge mechanism according to claim 1, further comprising an auxiliary mechanism to be provided between the cover and the chamber, for applying a force to the cover to rotate the cover.

7. A hinge mechanism according to claim 6, wherein the auxiliary mechanism comprises a link mechanism to be provided between the cover and the chamber to rotate with respect to the cover and the chamber, and bias means coupled to the link mechanism, for applying a force via the link mechanism to the cover to rotate the cover toward the opened position.

8. A hinge mechanism according to claim 7, wherein the bias means comprises a gas spring having a rod which extends by a gas pressure.

9. A hinge mechanism according to claim 1, further comprising a holding mechanism for holding the cover in the opened position.

10. A hinge mechanism according to claim 9, wherein the holding mechanism comprises a striker to be secured to the cover, and a latch mechanism for latching the striker when the cover is rotated to the opened position.

11. A hinge mechanism according to claim 10, further comprising means for releasing the striker from the latch mechanism.

12. A vacuum-process apparatus comprising:

chamber having a top wall and a hole made in the top wall and allowing an access to the chamber;

a cover for opening and closing the hole;

a hinge mechanism supporting the cover, enabling the cover to rotate through an angle greater than 90° between an opened position where the cover opens the hole and a closed position where the cover closes the hole, said hinge mechanism comprising:

an axle secured to the chamber;

a support member having a first part rotatably supported by the axle and a second part spaced apart from the first part;

a rotary member secured to the cover, rotatably supported by the second part of the support member and capable of rotating around the support member when the cover is rotated; and a rotation-transmitting mechanism supported by the support member and connecting the rotary member to the axle to allow the support member to rotate in a first direction around the axle when the rotary member is rotated in a second direction opposite to the first direction, wherein when the cover is rotated around the rotary member between the closed position and the opened position, the support member rotates in the direction opposite to the direction in which the cover is rotated.

13. A vacuum-process apparatus according to claim 12, wherein the rotation-transmitting mechanism comprises a first gear secured to the axle and axially aligned therewith, an intermediate gear rotatably mounted on the support member and set in mesh with the first gear, and a second gear secured to the rotary member and set in mesh with the intermediate gear.

14. A vacuum-process apparatus according to claim 12, wherein the rotation-transmitting mechanism comprises a first pulley secured to the axle and axially aligned therewith, a second pulley secured to the rotary member, and an endless belt wrapped around the first and second pulley.

15. A vacuum-process apparatus according to claim 12, wherein the rotary member has a shaft secured to the cover.

16. A vacuum-process apparatus according to claim 12, wherein the support member comprises a casing, and the rotation-transmitting mechanism is provided in the casing.

17. A vacuum-process apparatus according to claim 12, further comprising an auxiliary mechanism provided between the cover and the chamber, for applying a force to the cover to rotate the cover.

18. A vacuum-process apparatus according to claim 17, wherein the auxiliary mechanism comprises a link mechanism provided between the cover and the chamber to rotate with respect to the cover and the chamber, and bias means coupled to the link mechanism, for applying a force via the link mechanism to the cover to rotate the cover toward the opened position.

19. A vacuum-process apparatus according to claim 18, wherein the bias means comprises a gas spring having a rod which extends by a gas pressure.

20. A vacuum-process apparatus according to claim 12, further comprising a holding mechanism for holding the cover in the opened position.

* * * * *